US010875066B2

(12) United States Patent
McGahan

(10) Patent No.: US 10,875,066 B2
(45) **Date of Patent: *Dec. 29, 2020**

(54) BEARING FLOTATION COMPENSATION FOR METAL ROLLING APPLICATIONS

(71) Applicant: Honeywell International Inc., Morris Plains, NJ (US)

(72) Inventor: Paul McGahan, Prague (CZ)

(73) Assignee: Honeywell International Inc., Charlotte, NC (US)

( * ) Notice: Subject to any disclaimer, the term of this patent is extended or adjusted under 35 U.S.C. 154(b) by 657 days.

This patent is subject to a terminal disclaimer.

(21) Appl. No.: 15/609,264

(22) Filed: May 31, 2017

(65) Prior Publication Data

US 2018/0345341 A1 Dec. 6, 2018

(51) Int. Cl.

| | |
|---|---|
| ***B21B 37/62*** | (2006.01) |
| ***B21B 37/58*** | (2006.01) |
| ***B21B 31/07*** | (2006.01) |

(52) U.S. Cl.

CPC ..... *B21B 37/62* (2013.01); *B21B 31/074* (2013.01); *B21B 37/58* (2013.01); *B21B 2261/04* (2013.01);

(Continued)

(58) Field of Classification Search

CPC ..... B21B 37/62; B21B 37/00; B21B 31/074

See application file for complete search history.

(56) References Cited

U.S. PATENT DOCUMENTS 4,691,547 A * 9/1987 Teoh ..... B21B 37/66 72/10.7

6,263,714 B1 * 7/2001 Johnson ..... B21B 37/66 72/10.3

(Continued)

FOREIGN PATENT DOCUMENTS

| | | |
|---|---|---|
| EP | 0285333 A2 | 10/1988 |
| JP | 55-19491 A | 2/1980 |
| JP | 55-40027 A | 3/1980 |

OTHER PUBLICATIONS

Baramov, Lubomir, et al., "Kalman Filter for Systems with Communication Delay", Proceedings of the 1st IFAC Workshop on Estimation and Control of Networked Systems, Sep. 24-26, 2009, Venice, Italy, (2009), 310-315.

(Continued)

*Primary Examiner* — Mohammad Ali
*Assistant Examiner* — Vincent W Chang

(57) ABSTRACT

A process inferentially determines hydrodynamic bearing flotation in a metal rolling operation for a metal roller bearing. The process receives from a mill stand processing the metal roll a rolling load of the metal roll, a gap between a pair of rollers pressing the metal roll, and a speed of the metal roll through the pair of rollers. The process further receives from the mill stand a gauge of the metal roll after the metal roll has passed through the pair of rollers. The process determines the hydrodynamic bearing flotation using the rolling load of the metal roll, the gap between a pair of rollers pressing the metal roll, the speed of the metal roll through the pair of rollers, and the gauge of the metal roll after the metal roll has passed through the pair of rollers. The process then adjusts the gap between the pair of rollers based on the determined hydrodynamic bearing flotation.

16 Claims, 7 Drawing Sheets

(52) U.S. Cl.
CPC ..... *B21B 2265/12* (2013.01); *B21B 2271/02* (2013.01); *B21B 2275/06* (2013.01)

(56) References Cited

U.S. PATENT DOCUMENTS

2001/0050008 A1* 12/2001 Lesti ..... B05C 1/0834
101/147
2019/0041812 A1* 2/2019 Gafur ..... B21B 37/68

OTHER PUBLICATIONS

Trnka, Pavel, et al., "Biomass co-firing with inferential sensor", IFAC Symposium Power Plant and Power System Control, (2012), 6 pgs.
"European Application Serial No. 18172768.6, Extended European Search Report dated Oct. 12, 2018", 4 pgs.

* cited by examiner

BEARING FLOTATION COMPENSATION FOR METAL ROLLING APPLICATIONS

TECHNICAL FIELD

The present disclosure relates to a system and method for bearing flotation compensation in metal rolling operations.

BACKGROUND

Centerline thickness (gage) deviation is a key performance indicator (KPI) in any metal rolling application (ferrous, non-ferrous metals, hot or cold rolling). Despite the relative maturity of the metal rolling process and indeed the control technology that is associated with it, mill operators constantly strive for improved process performance. This is driven in part by the ultra-competitive economic market conditions in the metals industry in general.

There are many challenges to the design of robust, yet high performance, thickness control strategies. Challenges range from the presence of varying time delays between mill stand and measurement device, to significant non-linearity across the operating range. Furthermore, the requirement of fast disturbance rejection of measured disturbances (such as entry thickness and entry speed or un-measured internal disturbances such as roll eccentricity, thermal growth and thermo-mechanical wear of work rolls) presents a further challenge.

The hydrodynamic properties (film thickness, dynamic viscosity) of oil-film type bearings, commonly used in metal rolling mill construction, vary with mill process variables (rolling load and rolling speed). If left uncompensated, such variation inevitably leads to exit gage deviations, especially during mill speed acceleration and deceleration events at the beginning (directly after mill threading) and the end (directly before mill tail-out). A consequence of this gage deviation is reduced process yield (in extreme cases up to 10% reduction), and associated increased post-processing time/costs leading to a more complex and expensive product certification process.

Although each of these challenges are well known and reasonably well understood, there is a lack of a coordinated and systematic approach to thickness control design, which can incorporate all of the above features effectively.

DETAILED DESCRIPTION

Figure 1:
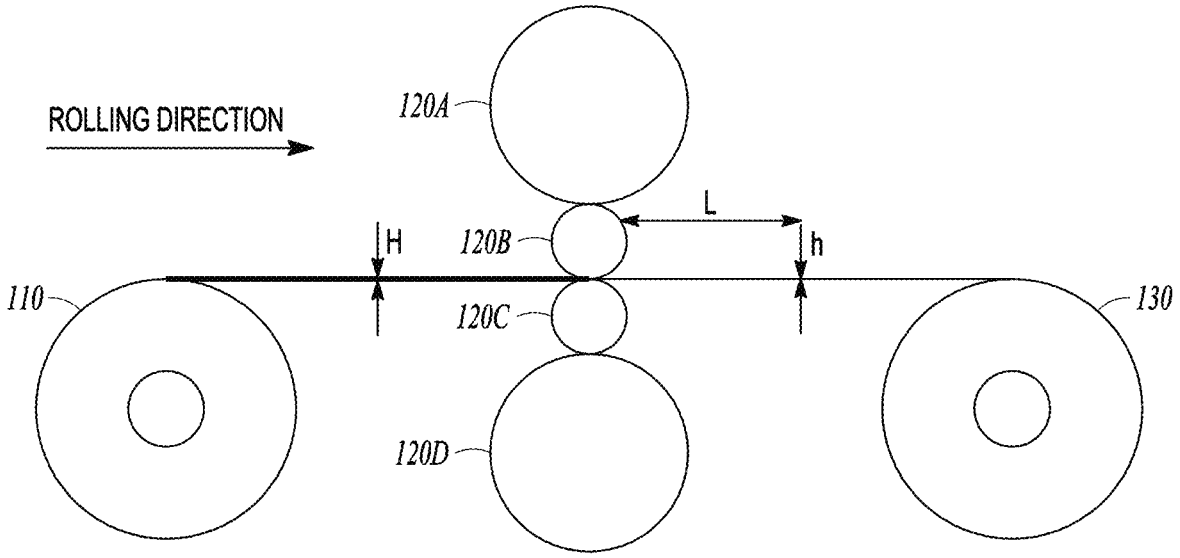
FIG. 1 is an illustration of a metal rolling mill.

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, electrical, and optical changes may be made without departing from the scope of the present invention. The following description of example embodiments is, therefore, not to be taken in a limited sense, and the scope of the present invention is defined by the appended claims.

A deficiency in existing metal rolling control solutions is the gage control performance during mill speed acceleration and deceleration events, corresponding to thread-in and tail-out of the mill. This leads to off-gage performance, thus reducing overall product quality and yield and increasing product post-processing time and cost. Common strategies used to address this deficiency consist of conducting tedious and time consuming experiments in order to characterize bearing flotation characteristics on a refined grid of operating points (typically defined in terms of mill load and mill speed). This characterization is then stored as a look-up table which is interpolated during rolling to obtain a bearing flotation compensation and which is used, typically in feed-forward, with existing gauge control techniques. This solution is clearly unable to adapt to inevitable changes in rolling mill conditions, such as leakages, ageing effects, etc.

An embodiment consists of similar initial experiments, albeit on a significantly courser grid of operating points to characterize a simplified model of the bearing flotation characteristics. This semi-empirical model has been derived from first principles insight and simplified to enable on-line usage in a real rolling mill application. Furthermore, this model of the bearing flotation characteristic is coupled with a simple rolling model, and the states (and selected parameters) of this model are estimated using an Extended Kalman Filter, built upon statistical inference, and specifically tailored for systems with uncertain parameters. This approach has the distinct advantage that the bearing flotation compensation is recursively estimated from process measurements, thus providing a degree of robustness to statistical noise and additional modeling inaccuracies.

One or more embodiments can be integrated into existing metal rolling control solutions. One or more embodiments can be practiced in a variety of forms, such as a standalone bearing flotation estimator that provides a feed-forward compensation to an existing gage control solution, a bearing flotation estimator, together with an exit gage estimator (BISRA or MassFlow), that provides both feed-forward compensation of bearing flotation and an estimation of the exit gauge for use by an existing feedback controller (PID controller), and a bearing flotation estimator that is integrated, together with, for example, roll eccentricity estimation, thermal growth estimation, as part of a coordinated control solution, which can be designed using, for example, linear quadratic regulator (LQR) techniques.

A particular embodiment relates to gage control in a single-stand, cold strip mill. However, other embodiments relate to virtually any type of metal rolling application. FIG. 1 is an illustration of a metal rolling mill. Incoming material from roller 110 of thickness H is reduced through a multiplicity of rolls 120A, 120B, 120C, and 120D (referred to as a stand) turning at a known speed $\omega_r$. The stand is equipped with a gap positioning system (mechanical, hydraulic or a combination of both). The material leaves the stand at thickness h, and gathered on roller 130. The control objective is to regulate this outgoing thickness h as closely as possible to a target $h_{ref}$.

The control problem is significantly complicated by the presence of a varying transportation delay between an exit thickness measurement device and the stand itself. This time varying transportation delay is characterized by the distance between stand centerline L in FIG. 1 and the stand speed $\omega_r$. It is well known that such time delay can have a destabilizing effect on control behavior and therefore the delay should be considered at the control design stage.

Figure 2:
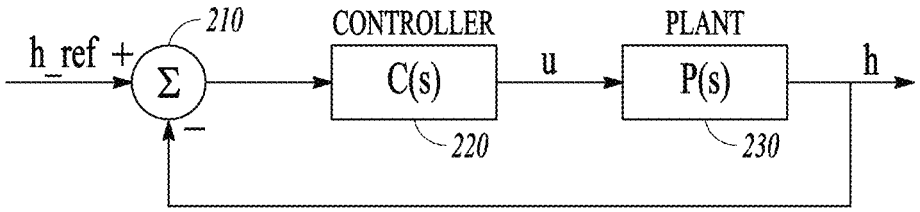
FIG. 2 is a block diagram of a PI feedback regulator.

A common and simple approach to address this delay issue is to directly deploy a PI regulator to control thickness. As a consequence of the time delay, the controller must be de-tuned, which leads to closed loop performance with limited bandwidth. This simple control structure is illustrated in FIG. 2. Specifically, in FIG. 2, metal roll thickness h is coming off of a roller stack in a plant 230. The thickness h is fed back to a summer or comparator 210, which compares the metal roll thickness h with the desired thickness $h_{ref}$. A controller 220 then controls the roll stack based on the output of the comparator 210.

Figure 3A:
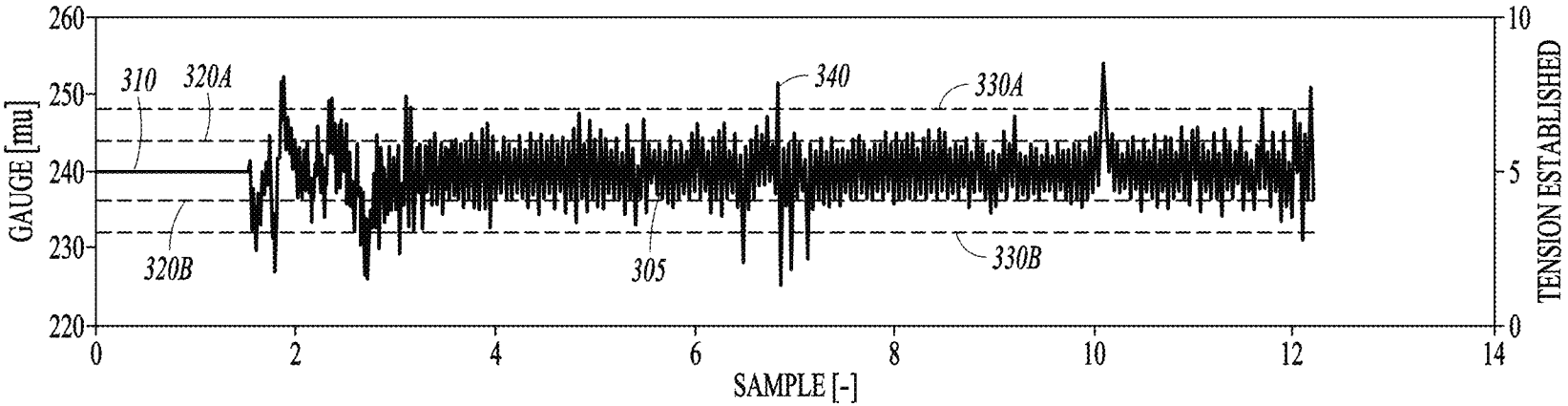
FIGS. 3A and 3B illustrate effects of bearing flotation on gage control performance.
Figure 3B:
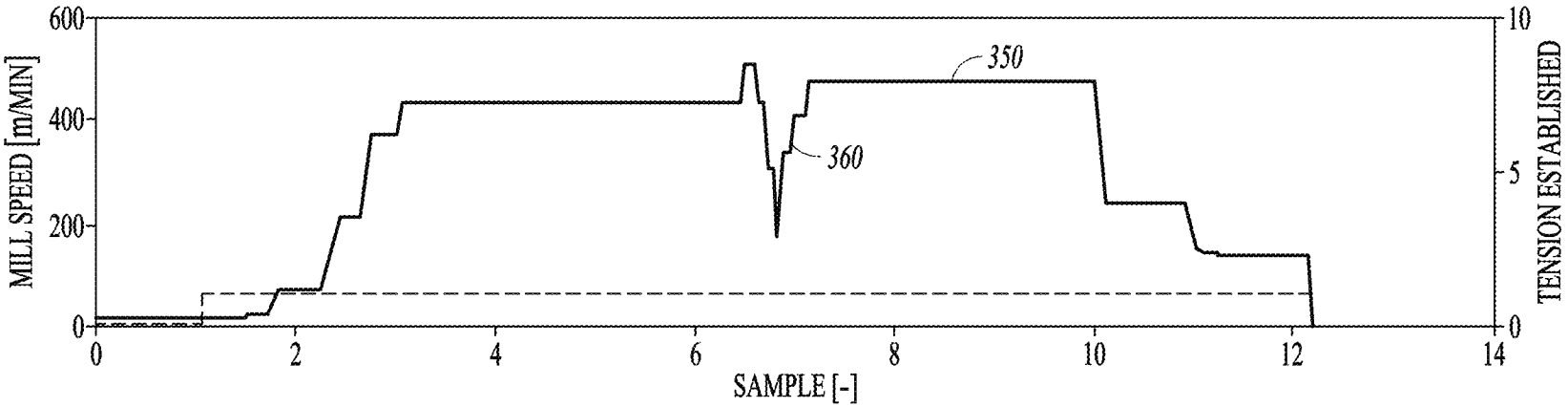

FIGS. 3A and 3B illustrate the effects of bearing flotation on the gage control performance of a mill stand, and in particular, poor gauge control performance due to bearing flotation effects. The desired gage ($h_{ref}$) is indicated by 310, and the gauge deviation at 305. The upper gauge deviation limit is indicated at 320A, and the lower gage deviation limit is indicated at 320B. The upper and lower limits on gauge deviation during mill acceleration and deceleration events are indicated at 330A and 330B respectively. FIG. 3B illustrates the speed of a mill roll at different sample times. The speed of the mill roll is indicated by plot 350. FIG. 3B further illustrates that a disruption in the speed of the mill roll, such as a deceleration illustrated at 360 (or an acceleration (not illustrated in FIG. 3B)), causes the gauge of the mill roll to spike to unacceptable levels as is illustrated at 340.

Bearing flotation effects are governed by the Reynolds equation, a partial differential equation governing the pressure distribution of thin viscous fluid films in lubrication theory. The Reynolds equation, derived from the Navier Stokes equations, in general has to be solved using numerical methods. However, for certain simplified cases analytical solutions exist. A simplified approximation to the solution of the Reynolds equation is given as:

$$c_{bf} = \frac{a(\omega/F)}{(\omega/F)+b}$$

where $\omega$ is the roll circumferential speed [m/min]

F is the total rolling load [tons]

a, b are parameters to be identified

Figure 4:
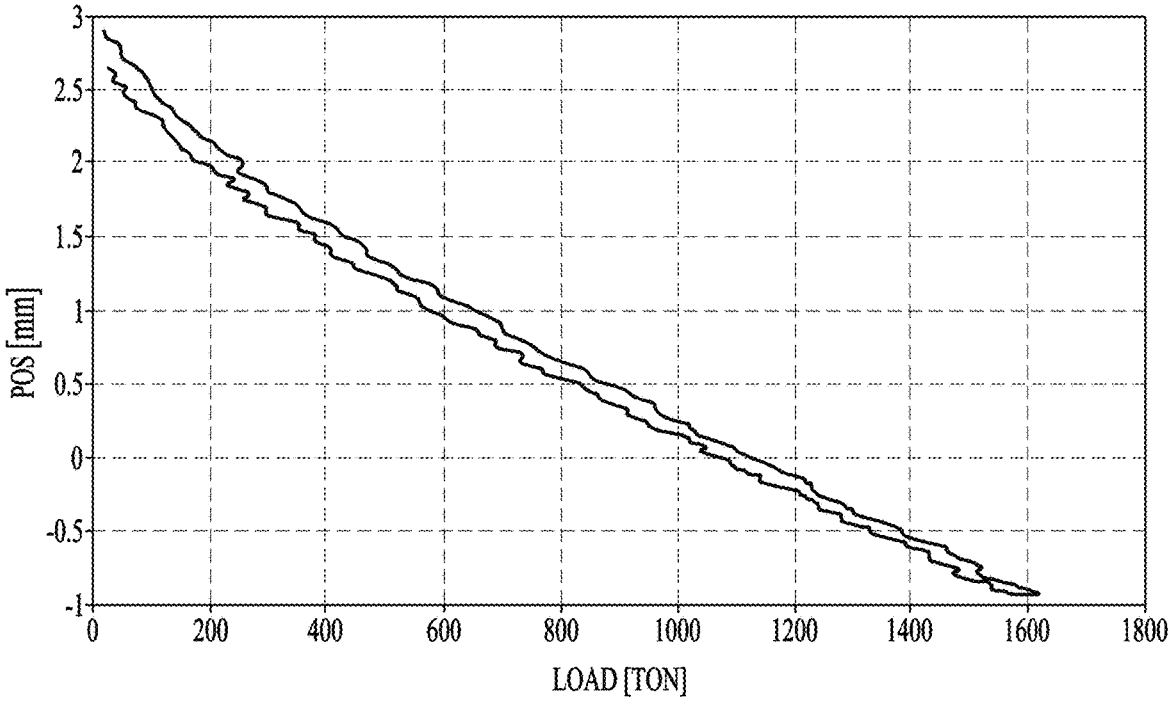
FIG. 4 illustrates an output of a hysteresis test involving controlling and recording the hydraulic cylinder position for a sequence of roll forces.

An experimental design for offline parameter identification of the bearing flotation model (and indeed the simplified rolling model presented in the following section) is simply an extension of the common hysteresis test, which can be referred to as a modified hysteresis test wherein both the mill roll speed and mill roll load are varied. Specifically, the modified hysteresis test consists of setting the mill to force control and recording the hydraulic cylinder position for a sequence of roll forces from minimum to maximum and back to minimum. An example of the output of such a test is given in FIG. 4. In a similar fashion to the bearing flotation model, the mill stretch can be modelled as:

$$g(F) = \frac{a_0 + a_1 F + a_2 F^2}{1 + b_1 F}$$

Figure 5:
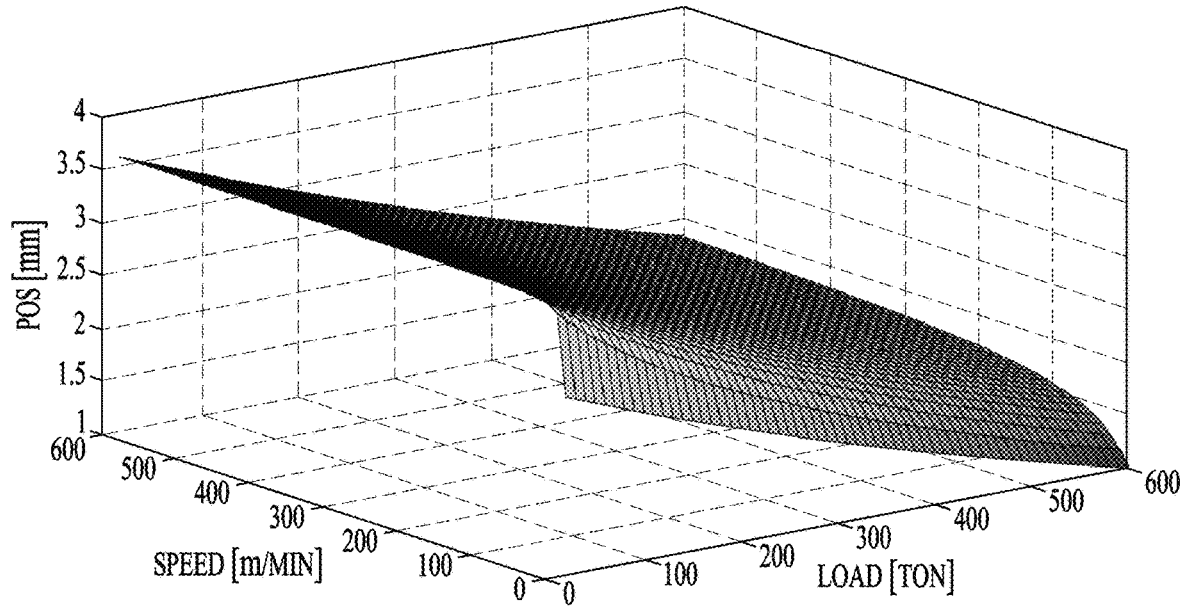
FIG. 5 illustrates typical results of a bearing flotation experiment plotted in the load and speed space.

In order to excite the speed dependencies, the bearing flotation test also requires modification of the rolling speed. At a discrete set of rolling loads $F_i$, i=1, . . . , M, the rolling speed is incremented from minimum to maximum and back to maximum, and the uncompensated screw positions $s_{ij}$ are recorded. For ease of visualization, typical results of the bearing flotation experiment are plotted in the load and speed space in FIG. 5, which can be seen as a combination of both mill stretch effects and bearing flotation effects.

The first step in an inferential sensor construction workflow is the modelling of a mill stand area. Although this is valid for any type of mill (single stand, reversing, or tandem), for the purposes of this discussion, a mill setup as illustrated in FIG. 1 is used. The key model components are as follows.

The first model component is a rolling model. A classical non-linear rolling model is used to simplify the roll contact area computations. This classical non-linear model is of the form:

$$[F_r\ P_r\ f_s]^T = f(H,h,k,R,W)$$

$F_r$ Rolling Load [N]

$P_r$ Rolling Torque [Nm]

$f_s$ Forward Slip [−]

k Material hardness [Pa]

R Roll Radius [m]

W Strip Width [m]

The second model component is the hydraulic gap control (HGC) model. As mentioned previously, the strip exit gauge depends on the roll gap s, which is controlled by the hydraulic capsule, and further depends on the mill stretch. The mill stretch is in turn a non-linear function of the rolling force. An expression for the exit thickness can then be written as:

$$h(s,\omega,F_r,t) = s + g(F_r) + c_{bf}(\omega/F_r) - s_0 - c_{tc}(t) - e_{br}(t)$$

g Mill Stretch [m]

$s_0$ Calibration screwdown [m]

$c_{tc}(t)$ Thermal growth as a function of time [m]

$e_{br}$ (t) Backup Roll Eccentricity as a function of time [m]

It is assumed that the dynamics of the HGC system are governed by the following differential equation:

$$\dot{s} = \frac{1}{T_{hgc}}(s_{ref} - s)$$

$s_{ref}$ HGC position reference [m]

$T_{hgc}$ HGC Time constant [s]

The third model component is a main drive model. It is assumed that a simple model of the main drive dynamics can be represented in the following form:

$$\dot{v}_{roll} = \frac{1}{T_{roll}}(v_{ref} - v_{roll})$$

$v_{roll}$ Work Roll Speed [m/s]

$v_{ref}$ Work Roll Speed Reference [m/s]

$T_{roll}$ Main Drive Time constant [s]

A model assembly process involves collecting the model components together and representing the model components in a compact form as a series of non-linear ordinary differential equations of the form:

$$\dot{x}(t)=f_c(x(t),u(t),\theta)+\nu_c(t)$$

$$y(t)=g(x(t),u(t),\theta)+e(t)$$

x Dynamic states of the model
u Model Inputs and measured disturbances
θ Estimatable parameters
y Model Outputs $$\mathrm{cov}(\nu_c(t))=Q_c(t),\ \mathrm{cov}(e(t))=R(t).$$

In a model linearization step, a continuous model is linearized around a nominal trajectory given by mean values of states and parameters:

$$\dot{x}(t)\approx f_c(\hat{x}(t),u(t),\hat{\theta})+A(t)\tilde{x}(t)+G(t)\tilde{\theta}(t)+\nu_c(t),$$

$$y(t)\approx g(\hat{x}(t),u(t),\theta)+C(t)\tilde{x}(t)+F(t)\tilde{\theta}(t)+e(t),$$

where variables with hats are mean values and variables with tildes are deviations from mean values and where:

$$A(t)=\left.\frac{\partial f_C(x,u,\theta)}{\partial x}\right|_{x=\hat{x}(t),u=u(t),\theta=\hat{\theta}},$$

$$G(t)=\left.\frac{\partial f_C(x,u,\theta)}{\partial \theta}\right|_{x=\hat{x}(t),u=u(t),\theta=\hat{\theta}},$$

$$C(t)=\left.\frac{\partial g(x,u,\theta)}{\partial x}\right|_{x=\hat{x}(t),u=u(t),\theta=\hat{\theta}},$$

$$F(t)=\left.\frac{\partial g(x,u,\theta)}{\partial \theta}\right|_{x=\hat{x}(t),u=u(t),\theta=\hat{\theta}}.$$

This gives a non-linear continuous model for state mean value:

$$\dot{\hat{x}}(t)\approx f_c(\hat{x}(t),u(t),\hat{\theta}),$$

and a linear model of state deviation from mean value as:

$$\dot{\tilde{x}}(t)\approx A(t)\tilde{x}(t)+G(t)\tilde{\theta}(t)+\nu_c(t).$$

Model discretization is accomplished as follows. For a state mean values discrete model, the non-linear differential equation will be discretized by Euler method:

$$\hat{x}_{k+1}=f(\hat{x}_k,u_k,\hat{\theta})$$

wherein $$f(x,u,\theta)=x+T_D f_C(x,u,\theta).$$

The discretization period $T_D$ is equal to sampling period $T_s$ or it is its fraction to improve Kalman filter (KF) time step precision.

A discrete model for state deviations can be obtained by standard ZOH discretization from linearized coefficients. Using Matlab notation:

$$[A_k,G_k,C_k,F_k]=c2d(A(t_k),G(t_k),C(t_k),F(t_k))$$

where $t_k$ is the continuous time equivalent to discrete sample index k. This is equivalent to the discretization of state-space model with input matrix $G(t_k)$ and input to output direct matrix $F(t_k)$. For non-shifted measurements:

$$C_k=C(t_k),\ F_k=F(t_k).$$

The discretized model is then:

$$\tilde{x}_{k+1}=A_k\tilde{x}_k+G_k\tilde{\theta}+\nu_k$$

$$\tilde{y}_k=C_k\tilde{x}_k+F_k\tilde{\theta}+e_k,$$

where for non-shifted measurements the covariances are:

$$\mathrm{cov}\begin{pmatrix} v_k \\ e_k \end{pmatrix}=\begin{bmatrix} Q_k & 0 \\ 0 & R_k \end{bmatrix}.$$

The measurement noise covariance is the same with the continuous model $R_k=R(t_k)$, and the discretization of process noise is described in the following paragraphs.

A simple discrete process noise covariance can be represented as:

$$Q_k=T_D Q_C(t_k).$$

A more advanced process noise discretization can be determined as follows.

Continuous noise model linearization:

$$\dot{x}_s(t)=A(t)x_s(t)+\nu_c(t),\ \mathrm{cov}(\nu_c(t))=Q_c(t).$$

The discrete process noise covariance under assumption that covariance $Q_C$ is constant on the discretization period:

$$Q_k=\int_0^{T_D} e^{A(t_k)\tau}Q_C(t_k)e^{A^T(t_k)\tau}d\tau.$$

This integral can be explicitly computed by $$Q_k=M_2^T M_1,$$

$$\text{where } \begin{pmatrix} \bullet & M_1 \\ 0 & M_2 \end{pmatrix}=\exp\left(\begin{pmatrix} -A(t_k) & Q_C(t_k) \\ 0 & A^T(t_k) \end{pmatrix}T_D\right).$$

The discrete noise covariance can be computed by matrix exponential or the computation can be further simplified by using exp(AT)≈I+AT $$\tilde{Q}_k=T_D Q(t_k)+T_D^2 A(t_k)Q(t_k),$$

$$Q_k=(\tilde{Q}_k+\tilde{Q}_k^T)/2$$

In an embodiment, an extended Kalman filter can be used as follows. It is assumed there exists a state estimate at sampling period k incorporating data $\{\ldots, u_{k-1}, y_{k-1}\}$.

$$x_k\sim N(\hat{x}_k,P_{x_k}).$$

It is noted that in this instance, correct double indexing k|k−1 is not used to simplify the notation. Parameters uncertainty (constant—without time indexing)

$$\theta\sim N(\hat{\theta},P_\theta).$$

The covariance of state and parameters $$\mathrm{cov}(x_k,\theta)=P_{x_k\theta},$$

is typically zero for an initial estimate.

A data step involves measurement linearization as follows.

Measurement linearization $$y_k\approx g(\hat{x}_k,u_k,\hat{\theta})+C_k\tilde{x}_k+F_k\tilde{\theta}_k+e_k,$$

where $\tilde{x}_k$ and $\tilde{\theta}_k$ are deviations from mean values. A joint covariance matrix:

$$\operatorname{cov}\begin{pmatrix} y_k \\ \theta \\ x_k \end{pmatrix} = \left(\begin{array}{c|cc} P_{y_k} & P_{y_k\theta} & P_{y_k x_k} \\ \hline P_{y_k\theta}^T & P_\theta & P_{\theta x_k} \\ P_{y_k x_k}^T & P_{\theta x_k}^T & P_{x_k} \end{array}\right),$$

where covariances related to measurement are:

$$P_{y_k\theta}=C_kP_{x_k\theta}+F_kP_\theta,$$

$$P_{y_kx_k}=C_kP_{x_k}+F_kP_{\theta x_k},$$

$$P_{y_k}=C_kP_{x_k}C_k^T+C_kP_{x_k\theta}F_k^T+F_kP_{\theta x_k}C_k^T+F_kP_\theta F_k^T+R_k.$$

A state update is then:

$$\hat{x}_k=\hat{x}_k+P_{x_k\theta}P_{y_k}^{-1}(y_k-g(\hat{x}_k,u_k,\hat{\theta})),$$

and covariance updates are:

$$P_{x_k|y_k}=P_{x_k}-P_{x_k y_k}P_{y_k}^{-1}P_{y_k x_k},$$

$$P_{\theta x_k|y_k}=P_{\theta x_k}-P_{\theta y_k}P_{y_k}^{-1}P_{y_k x_k}.$$

It is noted that covariance $P_\theta$ is not updated. The measurement function is usually not parameterized by θ. Then $F_k=0$ and the expressions simplify significantly.

A time step involves a time development of the state mean value (cannot be done by using linearized model as the model is not linearized in equilibrium in general) as follows.

$$\hat{x}_{k+1}=f(\hat{x}_k,u_k,\hat{\theta}).$$

Time development of state covariance:

$$P_{x_{k+1}} = \begin{pmatrix} G_k & A_k \end{pmatrix}\begin{pmatrix} P_\theta & P_{\theta x_k} \\ P_{\theta x_k}^T & P_{x_k} \end{pmatrix}\begin{pmatrix} G_k & A_k \end{pmatrix}^T + Q_k.$$

Time development of states and parameters covariance:

$$P_{\theta x_{k+1}}=P_{\theta x_k}A_k^T+P_\theta G_k^T.$$

Or alternatively in a single expression:

$$\begin{pmatrix} P_\theta & P_{\theta x_{k+1}} \\ P_{\theta x_{k+1}}^T & P_{x_{k+1}} \end{pmatrix} = \begin{pmatrix} I_{p\times p} & 0_{p\times n} \\ G_k & A_k \end{pmatrix}\begin{pmatrix} P_\theta & P_{\theta x_k} \\ P_{\theta x_k}^T & P_{x_k} \end{pmatrix}\begin{pmatrix} I_{p\times p} & 0_{p\times n} \\ G_k & A_k \end{pmatrix}^T + \begin{pmatrix} 0_{p\times p} & 0_{p\times n} \\ 0_{n\times p} & Q_k \end{pmatrix}.$$

If the discretization period $T_D$ is a fraction of the sampling period $T_s=NT_D$, then the time step is repeated N times.

In an uncertain Kalman filter in Cholesky factorization, a symmetric positive definite matrix P can be factorized as:

$$P=R^TR,$$

where R is upper triangular matrix. Then assuming known Cholesky factors of parameter θ and a state $x_k$ joint covariance matrix:

$$\begin{pmatrix} P_\theta & P_{\theta x_k} \\ P_{x_k\theta} & P_x \end{pmatrix} = \begin{pmatrix} R_\theta & K_{x_k|\theta} \\ & R_{x_k|\theta} \end{pmatrix}^T\begin{pmatrix} R_\theta & K_{x_k|\theta} \\ & R_{x_k|\theta} \end{pmatrix},$$

and Cholesky factor of measurement noise covariance $$R_k=R_{e_k}^TR_{e_k}.$$

To condition by measurement, the following is considered - - - Joint covariance of measurement $y_k$, parameters θ and states $x_k$ $$\operatorname{cov}\begin{pmatrix} y_k \\ \theta \\ x_k \end{pmatrix} = \left(\begin{array}{c|cc} P_{y_k} & P_{y_k\theta} & P_{y_k x_k} \\ \hline P_{y_k\theta}^T & P_\theta & P_{\theta x_k} \\ P_{y_k-x_k}^T & P_{\theta x_k}^T & P_{x_k} \end{array}\right) =$$

$$\begin{pmatrix} F_k & C_k & I_{f\times f} \\ I_{p\times p} & & \\ & I_{n\times n} & \end{pmatrix}\left(\begin{array}{cc|c} P_\theta & P_{\theta x_k} & \\ P_{\theta x_k}^T & P_{x_k}^T & \\ \hline & & R_k \end{array}\right)\begin{pmatrix} F_k & C_k & I_{f\times f} \\ I_{p\times p} & & \\ & I_{n\times n} & \end{pmatrix}^T,$$

and equivalently by using Cholesky factors $$\operatorname{cov}\begin{pmatrix} y_k \\ \theta \\ x_k \end{pmatrix} = \begin{pmatrix} F_k & C_k & I_{f\times f} \\ I_{p\times p} & & \\ & I_{n\times n} & \end{pmatrix}$$

$$\left(\begin{array}{cc|c} R_\theta & K_{x_k|\theta} & \\ & R_{x_k|\theta} & \\ \hline & & R_{e_k} \end{array}\right)^T\left(\begin{array}{cc|c} R_\theta & K_{x_k|\theta} & \\ & R_{x_k|\theta} & \\ \hline & & R_{e_k} \end{array}\right)\begin{pmatrix} F_k & C_k & I_{f\times f} \\ I_{p\times p} & & \\ & I_{n\times n} & \end{pmatrix}^T,$$

which simplifies to $$\operatorname{cov}\begin{pmatrix} y_k \\ \theta \\ x_k \end{pmatrix} =$$

$$\begin{pmatrix} R_\theta F_k^T + K_{x_k|\theta}C_k^T & R_\theta & K_{x_k|\theta} \\ R_{x_k|\theta}C_k^T & 0 & R_{x_k|\theta} \\ R_{e_k} & 0 & 0 \end{pmatrix}^T\begin{pmatrix} R_\theta F_k^T + K_{x_k|\theta}C_k^T & R_\theta & K_{x_k|\theta} \\ R_{x_k|\theta}C_k^T & 0 & R_{x_k|\theta} \\ R_{e_k} & 0 & 0 \end{pmatrix}.$$

Triangularization gives $$\operatorname{cov}\begin{pmatrix} y_k \\ \theta \\ x_k \end{pmatrix} = \left(\begin{array}{c|cc} R_{y_k} & K_{\theta|y_k} & K_{x_k|y_k} \\ \hline & R_{\theta|y_k} & K_{x_k|y_k\theta} \\ & & R_{x_k|y_k\theta} \end{array}\right)^T\left(\begin{array}{c|cc} R_{y_k} & K_{\theta|y_k} & K_{x_k|y_k} \\ \hline & R_{\theta|y_k} & K_{x_k|y_k\theta} \\ & & R_{x_k|y_k\theta} \end{array}\right),$$

where Cholesky factors of conditioned covariance can be read directly as $$\operatorname{cov}\left(\begin{matrix} \theta \\ x_k \end{matrix}\,\middle|\, y_k\right) = \begin{pmatrix} R_{\theta|y_k} & K_{x_k|y_k\theta} \\ & R_{x_k|y_k\theta} \end{pmatrix}^T\begin{pmatrix} R_{\theta|y_k} & K_{x_k|y_k\theta} \\ & R_{x_k|y_k\theta} \end{pmatrix}.$$

Mean value update $$x_k=x_k+K_{x_k|y_k}^TR_{y_k}^{-T}(y_k-g(\hat{x}_k,u_k,\hat{\theta})).$$

For parameters covariance recovery, after conditioning by measurement, the parameter covariance is $R_{\theta|y_k}^TR_{\theta|y_k}$. The goal is to recover it back to $R_\theta^TR_\theta$ while keeping the correct covariance with state in Cholesky factorized form. This can be done by adding independent noise to parameters with covariance $K_{\theta|y_k}^TK_{\theta|y_k}$ (exactly the information brought to parameters by measurement conditioning). In LD factors:

$$\left(\begin{array}{c|cc} I & I & 0 \\ 0 & 0 & I \end{array}\right)\left(\begin{array}{c|cc} K_{\theta|y_k} & & \\ \hline & R_{\theta|y_k} & K_{x_k|y_k\theta} \\ & & R_{x_k|y_k\theta} \end{array}\right)^T\left(\begin{array}{c|cc} K_{\theta|y_k} & & \\ \hline & R_{\theta|y_k} & K_{x_k|y_k\theta} \\ & & R_{x_k|y_k\theta} \end{array}\right)\left(\begin{array}{c|cc} I & I & 0 \\ 0 & 0 & I \end{array}\right)^T,$$

simplifies to $$\begin{pmatrix} K_{\theta|y_k} & 0 \\ R_{\theta|y_k} & K_{x_k|y_k\theta} \\ 0 & R_{x_k|y_k\theta} \end{pmatrix}^T\begin{pmatrix} K_{\theta|y_k} & 0 \\ R_{\theta|y_k} & K_{x_k|y_k\theta} \\ 0 & R_{x_k|y_k\theta} \end{pmatrix},$$

Triangularization and elimination of zero rows below diagonal gives final Cholesky factors for data step and parameters covariance recovery $$\mathrm{cov}\left(\begin{array}{c|c} \theta & \\ x_k & y_k \end{array}\right) = \begin{pmatrix} R_\theta & \overline{K}_{x_k|y_k\theta} \\ & \overline{R}_{x_k|y_k\theta} \end{pmatrix}^T\begin{pmatrix} R_\theta & \overline{K}_{x_k|y_k\theta} \\ & \overline{R}_{x_k|y_k\theta} \end{pmatrix}.$$

For a Cholesky time step, assuming a known Cholesky factor of parameter and state joint covariance matrix:

$$\begin{pmatrix} P_\theta & P_{\theta x_k} \\ P_{x_k\theta} & P_x \end{pmatrix} = \begin{pmatrix} R_\theta & K_{x_k|\theta} \\ & R_{x_k|\theta} \end{pmatrix}^T\begin{pmatrix} R_\theta & K_{x_k|\theta} \\ & R_{x_k|\theta} \end{pmatrix},$$

and a Cholesky factor of process noise covariance:

$$Q_k = R_{v_k}{}^T R_{v_k}.$$

Time development of the state mean value:

$$\hat{x}_{k+1} = f(\hat{x}_k, u_k, \hat{\theta})$$

The covariance matrix after time step can be written as:

$$\mathrm{cov}\begin{pmatrix} \theta \\ x_{k+1} \end{pmatrix} = \begin{pmatrix} P_\theta & P_{\theta x_{k+1}} \\ P_{\theta x_{k+1}} & P_{x_{k+1}} \end{pmatrix} =$$

$$\left(\begin{array}{cc|c} I_{p\times p} & 0_{p\times n} & 0_{p\times n} \\ G_k & A_k & I_{n\times n} \end{array}\right)\left(\begin{array}{cc|c} P_\theta & P_{\theta x_k} & \\ P_{\theta x_k}^T & P_{x_k}^T & \\ \hline & & Q_k \end{array}\right)\left(\begin{array}{cc|c} I_{p\times p} & 0_{p\times n} & 0_{p\times n} \\ G_k & A_k & I_{n\times n} \end{array}\right)^T,$$

and equivalently with Cholesky factors $$\mathrm{cov}\begin{pmatrix} \theta \\ x_{k+1} \end{pmatrix} = \left(\begin{array}{cc|c} I_{p\times p} & 0_{p\times n} & 0_{p\times n} \\ G_k & A_k & I_{n\times n} \end{array}\right)$$

$$\left(\begin{array}{cc|c} R_\theta & K_{x_k|\theta} & \\ & R_{x_k|\theta} & \\ \hline & & R_{v_k} \end{array}\right)^T\left(\begin{array}{cc|c} R_\theta & K_{x_k|\theta} & \\ & R_{x_k|\theta} & \\ \hline & & R_{v_k} \end{array}\right)\left(\begin{array}{cc|c} I_{p\times p} & 0_{p\times n} & 0_{p\times n} \\ G_k & A_k & I_{n\times n} \end{array}\right)^T,$$

which simplifies to $$\mathrm{cov}\begin{pmatrix} \theta \\ x_{k+1} \end{pmatrix} = \begin{pmatrix} R_\theta & R_\theta G_k^T + K_{x_k|\theta}A_k^T \\ 0 & R_{x_k|\theta}A_k^T \\ 0 & R_{v_k} \end{pmatrix}^T\begin{pmatrix} R_\theta & R_\theta G_k^T + K_{x_k|\theta}A_k^T \\ 0 & R_{x_k|\theta}A_k^T \\ 0 & R_{v_k} \end{pmatrix}$$

Triangularization and elimination of zero submatrix bellow diagonal gives Cholesky factors of parameter and state covariance after time step:

$$\mathrm{cov}\begin{pmatrix} \theta \\ x_{k+1} \end{pmatrix} = \begin{pmatrix} R_\theta & K_{x_{k+1}|\theta} \\ & R_{x_{k+1}|\theta} \end{pmatrix}^T\begin{pmatrix} R_\theta & K_{x_{k+1}|\theta} \\ & R_{x_{k+1}|\theta} \end{pmatrix}.$$

Figure 6A:
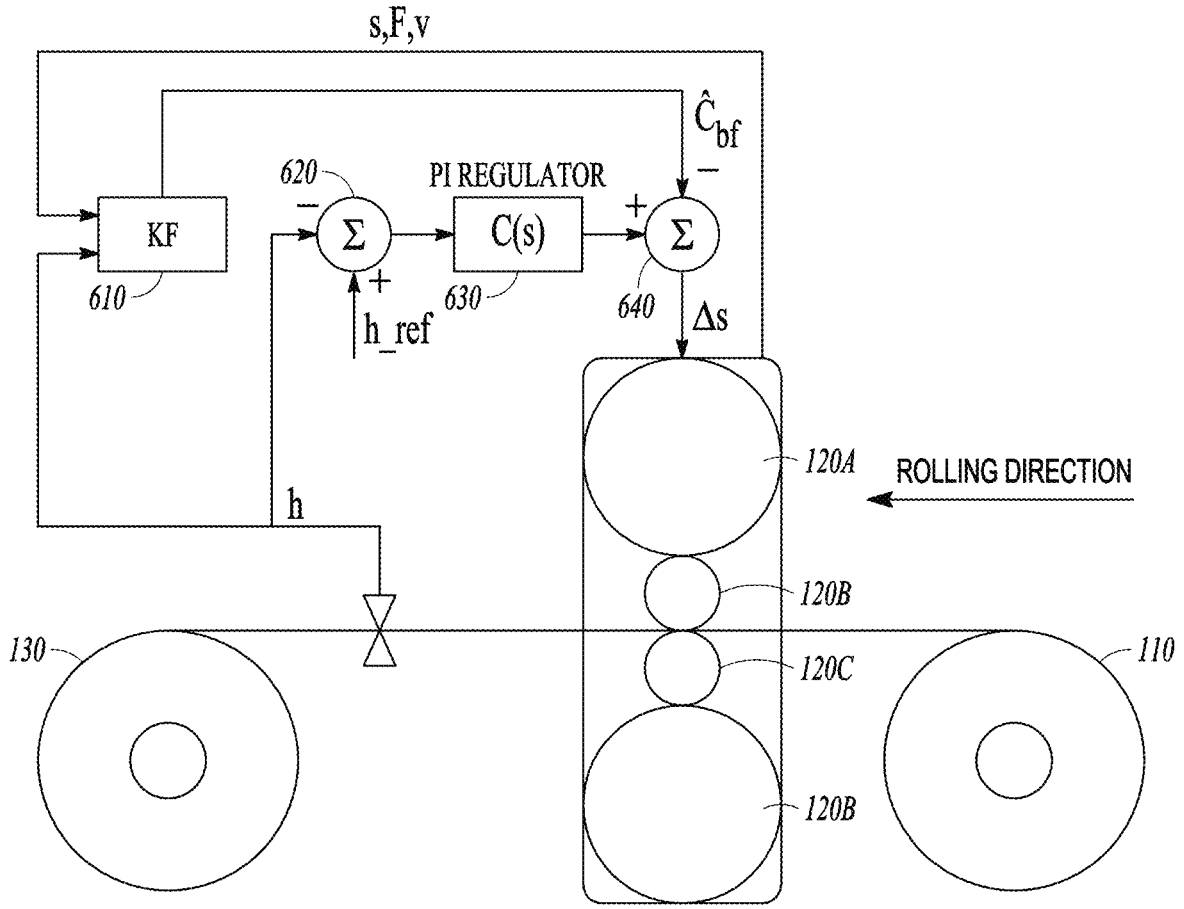
FIG. 6A illustrates a feedforward embodiment for inferentially determining bearing flotation.
Figure 6B:
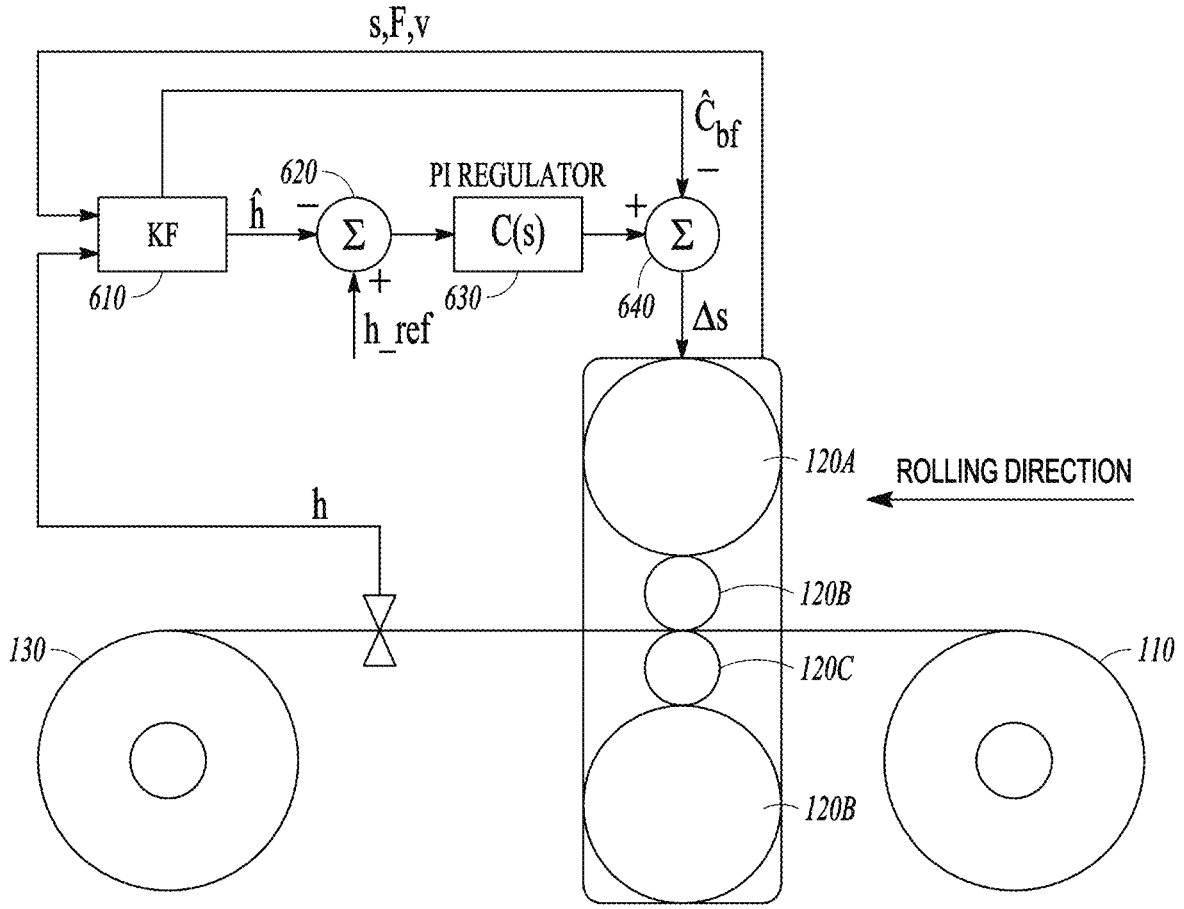
FIG. 6B illustrates a feedforward and feedback embodiment for inferentially determining bearing flotation.

FIG. 6A illustrates a feedforward embodiment for inferentially determining bearing flotation, and FIG. 6B illustrates a feedforward and feedback embodiment for inferentially determining bearing flotation. As illustrated in the feedforward embodiment of FIG. 6A, the gauge h of the roll exiting the roll stack 120 is input into a Kalman filter 610, along with the roll speed v, the roll load F, and the roll gap s. The Kalman filter 610 then fuses these data to approximate a solution to the Reynolds Equation, and feedforwards this solution to a comparator 640. The gauge h of the roll exiting the roll stack 120 is also input into a comparator 620, wherein it is compared with the desired roll gauge $h_{ref}$. The output of the comparator 620 is input into a PI regulator 630, and the output of the PI regulator 630 is input to the comparator 640 for processing with the solution to the Reynolds Equation.

In the feedback and feedforward embodiment of FIG. 6B, the gauge h of the roll exiting the roll stack 120 is input into a Kalman filter 610, along with the roll speed v, the roll load F, and the roll gap s. The Kalman filter 610 then fuses these data to approximate a solution to the Reynolds Equation, and feedforwards this solution to a comparator 640. The output of the Kalman filter 610 is also provided to the comparator 620 for a feedback comparison with $h_{ref}$. The output of the comparator 620 is input into a PI regulator 630, and the output of the PI regulator 630 is input to the comparator 640 for processing with the solution to the Reynolds Equation.

Figure 7A:
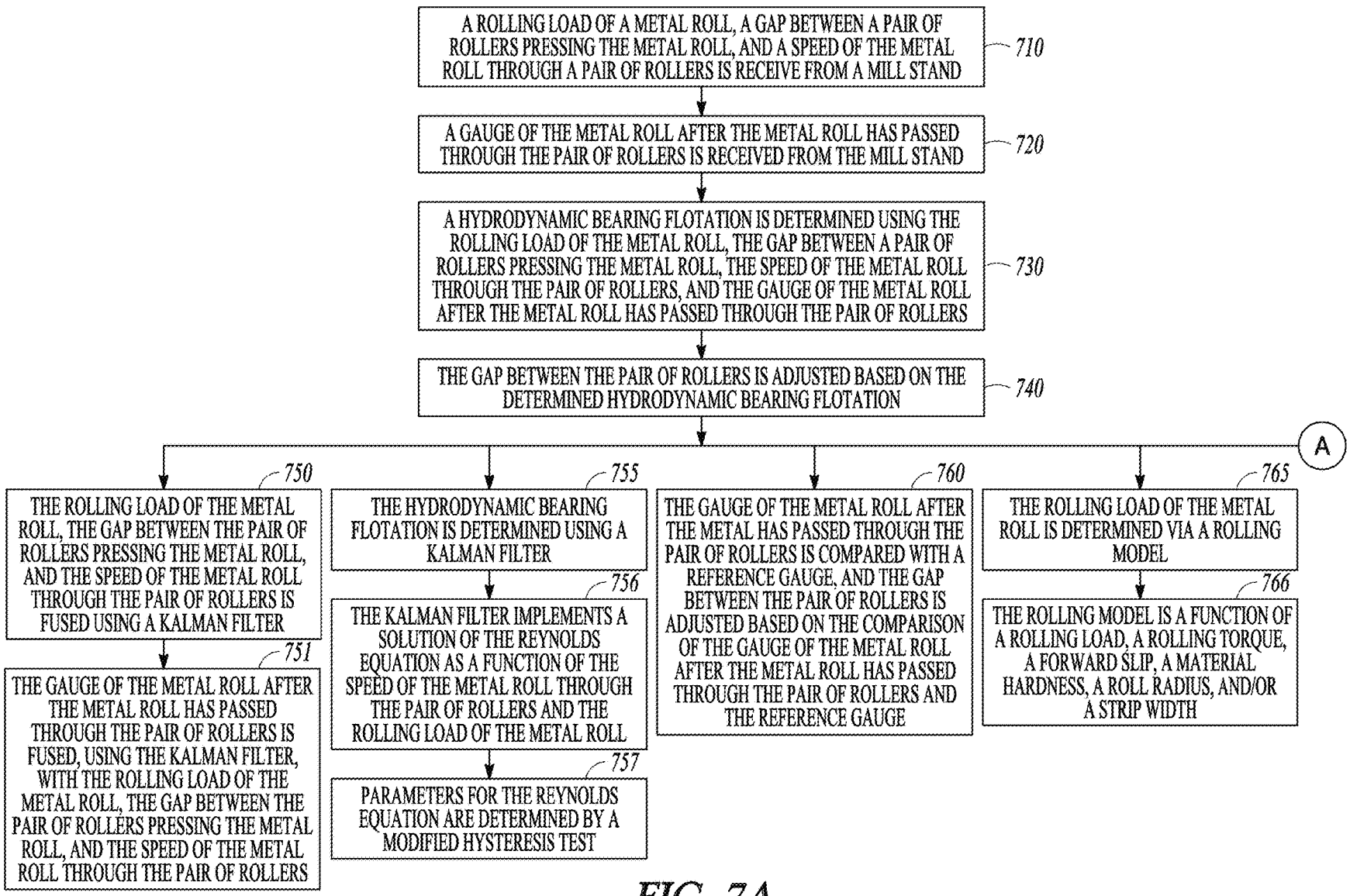
FIGS. 7A and 7B are a block diagram illustrating operations and features of a system and method to inferentially determine bearing flotation in a mill stack.
Figure 7B:
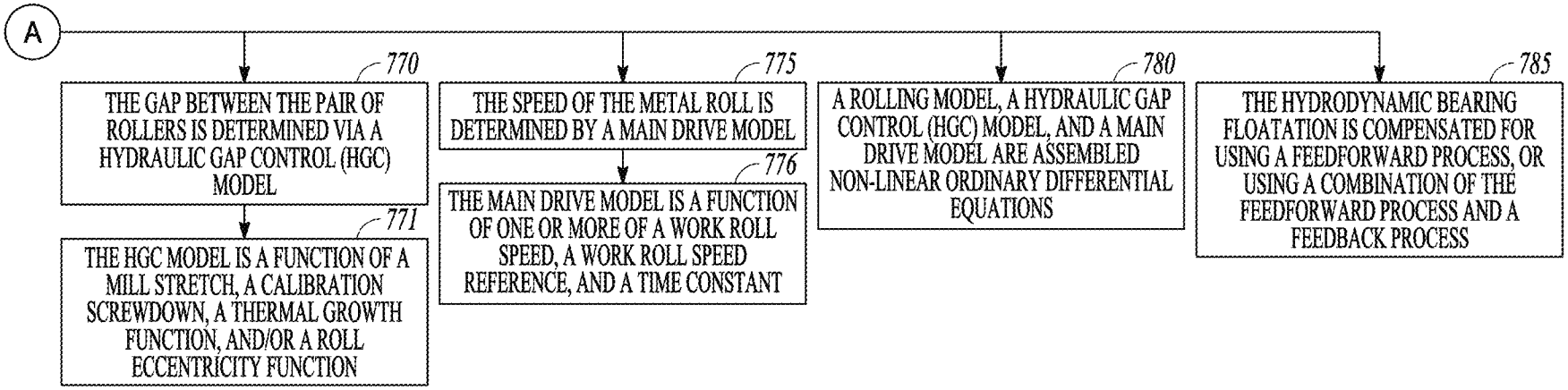

FIGS. 7A and 7B are a block diagram illustrating operations and features of a system and method to inferentially determine bearing flotation in a mill stack. FIGS. 7A and 7B include a number of blocks 710-785. Though arranged substantially serially in the example of FIGS. 7A and 7B, other examples may reorder the blocks, omit one or more blocks, and/or execute two or more blocks in parallel using multiple processors or a single processor organized as two or more virtual machines or sub-processors. Moreover, still other examples can implement the blocks as one or more specific interconnected hardware or integrated circuit modules with related control and data signals communicated between and through the modules. Thus, any process flow is applicable to software, firmware, hardware, and hybrid implementations.

Referring now to FIGS. 7A and 7B, at 710, a rolling load of a metal roll, a gap between a pair of rollers pressing the metal roll, and a speed of the metal roll through a pair of rollers is received from a mill stand. At 720, a gauge of the metal roll after the metal roll has passed through the pair of rollers is received from the mill stand. At 730, a hydrodynamic bearing flotation is determined using the rolling load of the metal roll, the gap between a pair of rollers pressing the metal roll, the speed of the metal roll through the pair of rollers, and the gauge of the metal roll after the metal roll has passed through the pair of rollers. At 740, the gap between the pair of rollers is adjusted based on the determined hydrodynamic bearing flotation.

At 750, the rolling load of the metal roll, the gap between the pair of rollers pressing the metal roll, and the speed of the metal roll through the pair of rollers is fused using a Kalman filter, and at 751, the gauge of the metal roll after the metal roll has passed through the pair of rollers is fused, using the Kalman filter, with the rolling load of the metal roll, the gap between the pair of rollers pressing the metal roll, and the speed of the metal roll through the pair of rollers.

At 755, the hydrodynamic bearing flotation is determined using a Kalman filter. At 756, the Kalman filter implements a solution of the Reynolds Equation as a function of the speed of the metal roll through the pair of rollers and the rolling load of the metal roll. At 757, one or more parameters for the Reynolds Equation are determined by a modified hysteresis test. The modified hystersis test involves varying both the both the mill roll speed and mill roll load.

At 760, the gauge of the metal roll after the metal has passed through the pair of rollers is compared with a reference gauge, and the gap between the pair of rollers is adjusted based on the comparison of the gauge of the metal roll after the metal roll has passed through the pair of rollers and the reference gauge. This adjustment is in addition to the hydrodynamic bearing flotation adjustment of operation 740.

At 765, the rolling load of the metal roll is determined via a rolling model. In an embodiment, as indicated at 766, the rolling model is a function of a rolling load, a rolling torque, a forward slip, a material hardness, a roll radius, and/or a strip width. The rolling model simplifies a computation relating to a contact area of a roll.

At 770, the gap between the pair of rollers is determined via a hydraulic gap control (HGC) model. At 771, the HGC model is a function of a mill stretch, a calibration screw-down, a thermal growth function, and/or a roll eccentricity function.

At 775, the speed of the metal roll is determined by a main drive model, and at 776, the main drive model is a function of one or more of a work roll speed, a work roll speed reference, and a time constant.

At 780, a rolling model, a hydraulic gap control (HGC) model, and a main drive model are assembled into one or more non-linear ordinary differential equations. At 785, the hydrodynamic bearing flotation is compensated for using a feedforward process, or using a combination of the feedforward process and a feedback process. An example of a feedforward process is illustrated in FIG. 6A, and an example of a combination of a forward process and a feedback process are illustrated in FIG. 6B.

It should be understood that there exist implementations of other variations and modifications of the invention and its various aspects, as may be readily apparent, for example, to those of ordinary skill in the art, and that the invention is not limited by specific embodiments described herein. Features and embodiments described above may be combined with each other in different combinations. It is therefore contemplated to cover any and all modifications, variations, combinations or equivalents that fall within the scope of the present invention.

The Abstract is provided to comply with 37 C.F.R. § 1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate example embodiment.

The invention claimed is:

1. A process to inferentially determine hydrodynamic bearing flotation in a metal rolling operation for a metal roller bearing, comprising:

receiving from a mill stand processing the metal roll a rolling load of the metal roll, a gap between a pair of rollers pressing the metal roll, and a speed of the metal roll through the pair of rollers;

receiving from the mill stand a gauge of the metal roll after the metal roll has passed through the pair of rollers;

determining the hydrodynamic bearing flotation using the rolling load of the metal roll, the gap between a pair of rollers pressing the metal roll, the speed of the metal roll through the pair of rollers, and the gauge of the metal roll after the metal roll has passed through the pair of rollers; and adjusting the gap between the pair of rollers based on the determined hydrodynamic bearing flotation;

wherein the rolling load of the metal roll, the gap between the pair of rollers pressing the metal roll, and the speed of the metal roll through the pair of rollers is fused using a Kalman filter;

wherein the hydrodynamic bearing flotation is determined using the Kalman filter;

wherein the Kalman filter implements a solution of the Reynolds Equation as a function of the speed of the metal roll through the pair of rollers and the rolling load of the metal roll;

wherein one or more parameters for the Reynolds Equation are determined by a modified hysteresis test; and wherein the adjusting the gap is executed during mill speed acceleration and deceleration.

2. The process of claim 1, wherein the gauge of the metal roll after the metal roll has passed through the pair of rollers is fused, using the Kalman filter, with the rolling load of the metal roll, the gap between the pair of rollers pressing the metal roll, and the speed of the metal roll through the pair of rollers.

3. The process of claim 1, comprising comparing the gauge of the metal roll after the metal has passed through the pair of rollers with a reference gauge, and adjusting the gap between the pair of rollers based on the comparison of the gauge of the metal roll after the metal roll has passed through the pair of rollers and the reference gauge.

4. The process of claim 1, wherein the rolling load of the metal roll is determined via a rolling model.

5. The process of claim 4, wherein the rolling model is a function of one or more of a rolling load, a rolling torque, a forward slip, a material hardness, a roll radius, and a strip width, and wherein the rolling model simplifies a computation relating to a contact area of a roll.

6. The process of claim 1, wherein the gap between the pair of rollers is determined via a hydraulic gap control (HGC) model.

7. The process of claim 6, wherein the HGC model is a function of one or more of a mill stretch, a calibration screwdown, a thermal growth function, and a roll eccentricity function.

8. The process of claim 1, wherein the speed of the metal roll is determined by a main drive model.

9. The process of claim 8, wherein the main drive model is a function of one or more of a work roll speed, a work roll speed reference, and a time constant.

10. The process of claim 1, wherein a rolling model, a hydraulic gap control (HGC) model, and a main drive model are assembled into one or more non-linear ordinary differential equations.

11. The process of claim 1, wherein the hydrodynamic bearing flotation is compensated for using a feedforward process, or using a combination of the feedforward process and a feedback process.

12. A non-transitory computer-readable medium comprising instructions that when executed by a processor execute a process to inferentially determine hydrodynamic bearing flotation in a metal rolling operation for a metal roller bearing, comprising:

receiving from a mill stand processing the metal roll a rolling load of the metal roll, a gap between a pair of rollers pressing the metal roll, and a speed of the metal roll through the pair of rollers;

receiving from the mill stand a gauge of the metal roll after the metal roll has passed through the pair of rollers;

determining the hydrodynamic bearing flotation using the rolling load of the metal roll, the gap between a pair of rollers pressing the metal roll, the speed of the metal roll through the pair of rollers, and the gauge of the metal roll after the metal roll has passed through the pair of rollers; and adjusting the gap between the pair of rollers based on the determined hydrodynamic bearing flotation;

wherein the rolling load of the metal roll, the gap between the pair of rollers pressing the metal roll, and the speed of the metal roll through the pair of rollers is fused using a Kalman filter;

wherein the hydrodynamic bearing flotation is determined using the Kalman filter;

wherein the Kalman filter implements a solution of the Reynolds Equation as a function of the speed of the metal roll through the pair of rollers and the rolling load of the metal roll;

wherein one or more parameters for the Reynolds Equation are determined by a modified hysteresis test; and wherein the adjusting the gap is executed during mill speed acceleration and deceleration.

13. The non-transitory computer-readable medium of claim 12, wherein the gauge of the metal roll after the metal roll has passed through the pair of rollers is fused, using the Kalman filter, with the rolling load of the metal roll, the gap between the pair of rollers pressing the metal roll, and the speed of the metal roll through the pair of rollers.

14. The non-transitory computer-readable medium of claim 12, comprising instructions for assembling a rolling model, a hydraulic gap control (HGC) model, and a main drive model into one or more non-linear ordinary differential equations.

15. A system comprising:

a computer processor; and a computer memory coupled to the computer processor;

wherein the computer processor is operable for:

receiving from a mill stand processing the metal roll a rolling load of the metal roll, a gap between a pair of rollers pressing the metal roll, and a speed of the metal roll through the pair of rollers;

receiving from the mill stand a gauge of the metal roll after the metal roll has passed through the pair of rollers;

determining a hydrodynamic bearing flotation using the rolling load of the metal roll, the gap between a pair of rollers pressing the metal roll, the speed of the metal roll through the pair of rollers, and the gauge of the metal roll after the metal roll has passed through the pair of rollers; and adjusting the gap between the pair of rollers based on the determined hydrodynamic bearing flotation;

wherein the rolling load of the metal roll, the gap between the pair of rollers pressing the metal roll, and the speed of the metal roll through the pair of rollers is fused using a Kalman filter;

wherein the hydrodynamic bearing flotation is determined using the Kalman filter;

wherein the Kalman filter implements a solution of the Reynolds Equation as a function of the speed of the metal roll through the pair of rollers and the rolling load of the metal roll;

wherein one or more parameters for the Reynolds Equation are determined by a modified hysteresis test; and wherein the adjusting the gap is executed during mill speed acceleration and deceleration.

16. The system of claim 15, wherein the computer processor is operable for compensating for the hydrodynamic bearing flotation by using a feedforward process, or using a combination of the feedforward process and a feedback process.

* * * * *